US005358252A

United States Patent [19]

McPhaul

[11] Patent Number: 5,358,252

[45] Date of Patent: Oct. 25, 1994

[54] THREE-DIMENSIONAL MULTI-TIERED CHESS BOARD

[76] Inventor: Alfred McPhaul, Rte. 1, Box 667-D, Red Springs, N.C. 28377

[21] Appl. No.: 157,227

[22] Filed: Nov. 23, 1993

[51] Int. Cl.[5] ..... A63F 3/02

[52] U.S. Cl. ..... 273/241; 273/287; 273/309; D21/24; D21/23

[58] Field of Search ..... 273/241, 287, 309, 284; D21/16, 23, 24

[56] References Cited

U.S. PATENT DOCUMENTS

D. 210,542 3/1968 Stookey ..... 273/241

D. 328,476 8/1992 Titus ..... D21/24

527,279 10/1894 Green ..... 273/284

4,099,723 7/1978 Robinson ..... 273/241

*Primary Examiner*—Benjamin H. Layno

*Attorney, Agent, or Firm*—Olive & Olive

[57] ABSTRACT

A square multi-tiered game board primarily for use in the games of chess and checkers which includes a plurality of upward facing, parallel, horizontal tiers, each said tier enclosing a center space therebetween. The tiers are arranged in internally descending order starting at the upper and outermost tier of the game board and descending stepwise to an innermost and lowest tier.

9 Claims, 4 Drawing Sheets

THREE-DIMENSIONAL MULTI-TIERED CHESS BOARD

BACKGROUND OF THE INVENTION

1. Field of the Invention

This invention relates to game boards, and in particular pertains to a multi-tiered game board primarily for use in the games of chess and checkers.

2. Description of the Related Art

A traditional chess board is a square board with a single upwardly facing horizontal playing surface consisting of sixty-four equal-sized game piece position squares. Each position square is one of two possible colors which alternate along the playing surface. The game board is usually supported for play on a horizontal surface such as a floor or a table.

In a traditional chess game a player moves game pieces in a complex spatial pattern designed to outwit the opposing player and to win by capture of the opposing player's "King" piece. The complexity of chess stems from the six different predetermined movement patterns of the sixteen chess pieces allocated to each player and the nearly infinite variety of potential geometric patterns available to each player at the start of the game. Obviously, the game of chess is quite complex and is highly valued by players not only for the joy of a challenge but for intellectual skills that develop with continued play.

However, traditional chess piece movement and potential movement patterns are restricted by the playing surface upon which they move, i.e., all chess piece moves are restricted to the horizontal plane. As a result, three-dimensional spatial planning and strategizing is an intellectual skill not developed by traditional chess.

It is therefore an object of this invention to provide a playing surface that allows for traditional chess piece movement and movement patterns in the vertical plane, and thus for movement planning and strategizing in the three dimensions.

It is a further object of this invention to provide a multi-tiered game board for checkers or other games that utilize the traditional chess game board.

It is a further object of this invention to provide a multi-tiered game board inset and mounted to the top surface of a table and a cover panel to enclose the game board when not in use.

Other objects and advantages will be more fully apparent from the following disclosure and appended claims.

SUMMARY OF THE INVENTION

A multi-tiered game board having a plurality of horizontal tiers, each of said tiers having an upwardly facing playing surface enclosing a center space therebetween, said playing surfaces being arranged in an internally descending stepwise order, such that each successive said internally descending playing surface is one step down, parallel to and immediately interior to said playing surface located immediately above.

The preferred embodiment is a multi-tiered chess game board having four tiers: two intermediate tiers, an upper tier and a lower tier. The upper tier is a square perimeter having a horizontal upward facing playing surface, each side measuring one game square wide and eight game squares long. A first intermediate tier has an upward facing playing surface positioned parallel to, below and immediately interior to the playing surface of the upper tier. A second intermediate tier has an upward facing playing surface positioned parallel to, below and immediately interior to the playing surface of the first intermediate tier. A lower tier has an upward facing playing surface positioned below, parallel to, below and intermediately interior to the playing surface of the second intermediate tier. All tiers are supported in relationship to each other by a vertical support system. Traditional chess pieces and chess piece moves are used in conjunction with the multi-tiered chess board. The multi-tiered board may be inserted into an appropriate size opening in the top surface of a table and mounted thereon. The top surface of the game board may be enclosed by a cover panel. The cover panel may be free or hingably attached to either the table or the game board.

DETAILED DESCRIPTION OF THE INVENTION AND PREFERRED EMBODIMENTS THEREOF

Figure 1:
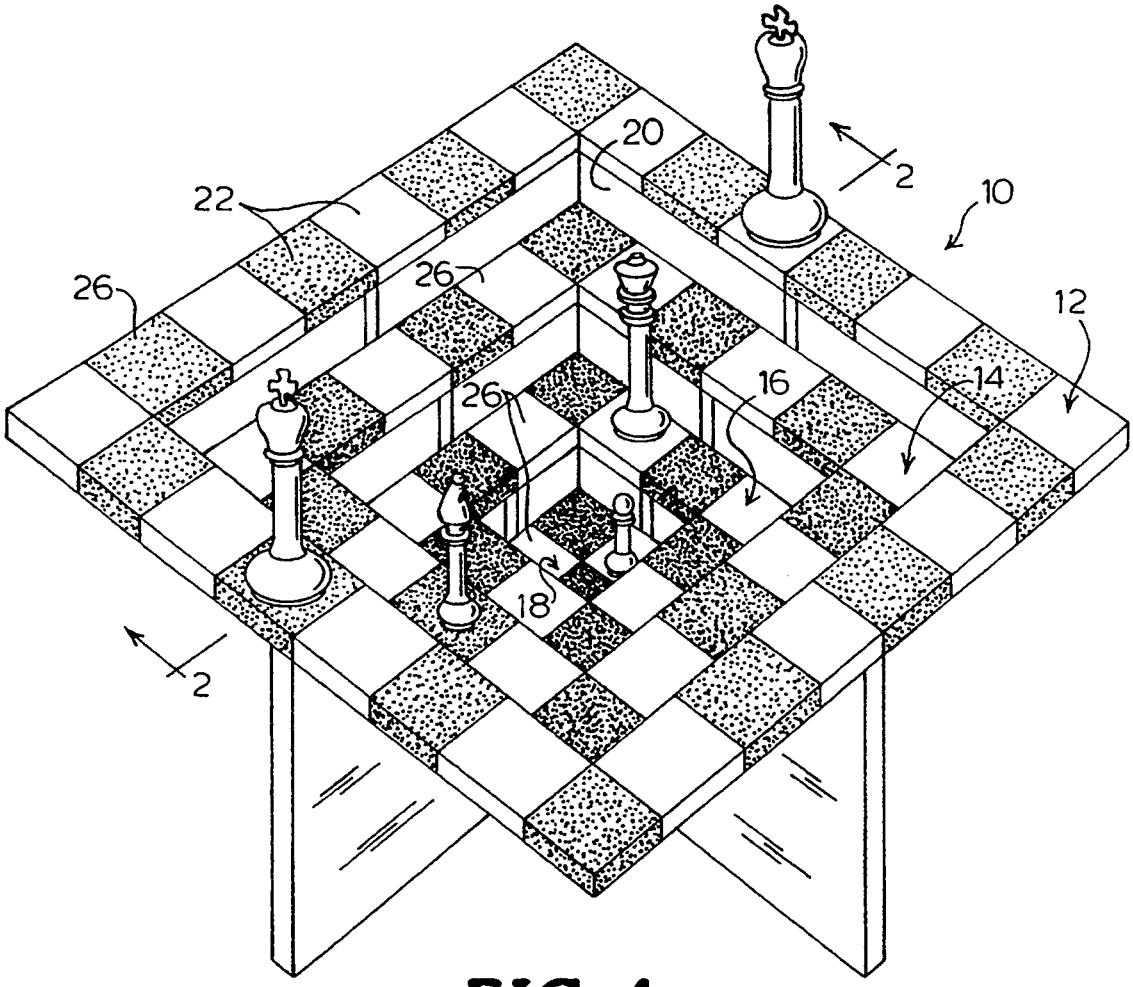
FIG. 1 is a top perspective view of the three-dimensional game board of the preferred embodiment.

The present invention is a three-dimensional multi-tiered game board for playing chess or other appropriate board games. The multi-tiered game board can be made from a single mold using a variety of substances such as plastic or it can be made without a mold from wood or other appropriate materials. As illustrated in FIG. 1 showing the preferred embodiment, the multi-tiered game board 10 includes a plurality of horizontal tiers 12, 14, 16, and 18 each of said tiers having an upwardly facing playing surface 26 enclosing a center space therebetween, said playing surfaces 26 being arranged in an internally descending stepwise order, such that each successive said internally descending playing surface 26 is one step down, parallel to and immediately interior to said playing surface 26 located immediately above. It is understood that the present invention may be functional with a variety of games. As a result, the present invention can be made with a different number of tiers and different sizes and shapes of tiers.

According to the preferred embodiment as shown in FIG. 1, the three-dimensional multi-tiered game board 10 of the invention is shown having an upwardly facing playing surface 26 consisting of sixty-four equal sized game piece position squares, each position square being identified as 22. Each position square 22 is one of two possible colors. As used herein, the term "colors" means any visual appearance allowing alternate squares to be distinguished. The position squares 22 alternate from one color to the other along the playing surface 26.

The playing surface 26 is multi-tiered. The upper tier 12 has four sides forming a square, said sides enclosing a center space positioned therebetween and each side having a horizontal upward facing playing surface measuring one position square 22 wide and eight position squares 22 long. A first intermediate tier 14 has four sides forming a square, said sides enclosing a center space positioned therebetween and each side having an upward facing playing surface 26 measuring one position square 22 wide and six position squares 22 long and is one step down, parallel to and immediately interior to the upper tier 12 playing surface 26. A second intermediate tier 16 has four sides forming a square, said sides enclosing a center space positioned therebetween and each side having an upward facing playing surface 26 measuring one position square 22 wide and four position squares 22 long and is one step down, parallel to and immediately interior to the first intermediate tier 14 playing surface 26. A lower level 18 has four sides forming a square, each side having an upward facing playing surface 26 measuring one position square 22 wide and two position squares 22 long and is one step down, parallel to and immediately interior to the second intermediate tier 16 playing surface 26.

In the preferred embodiment a vertical support system for the multi-tiered playing surface includes a series of risers 20 located between each tier to permanently support the tiers in a fixed stepped relationship to each other. An angle support 38 or other support system known in the art is preferably added to further support the tiers in a fixed stepped relationship to each other.

Figure 2:
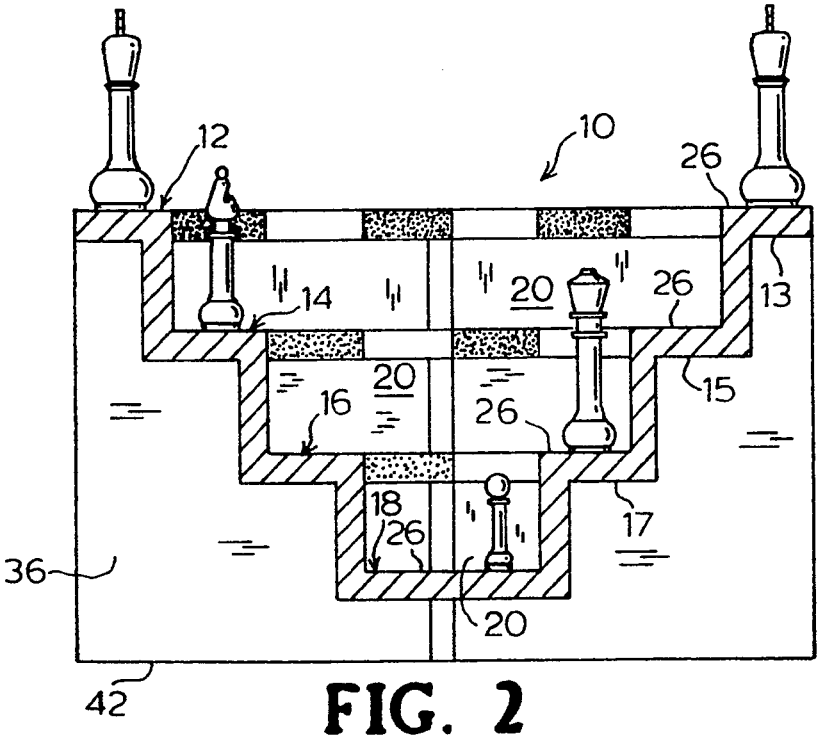
FIG. 2 is a cross-sectional view taken along line 2—2 of FIG. 1.
Figure 3:
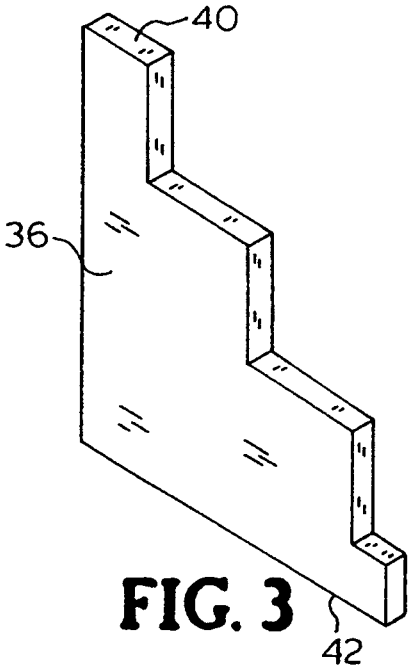
FIG. 3 is a perspective view of a support leg.

One preferred embodiment for supporting the multi-tiered chess board 10 includes a plurality of support legs 36 each having an upper surface 40 attached to the lower surface 13 of upper tier 12, the lower surface 15 of the first intermediate tier 14, lower surface 17 of the second intermediate tier 16, lower surface 19 of lower tier 18, extending downwardly and having a downwardly facing surface 42 to support the chess board 10 upon any flat surface for play (FIGS. 1–3). Additionally, the support legs brace the multi-tier game board 10 so as to retain the board's original shape after continued use and movement to other sites. It is well understood that there are many constructions known to those in the art to brace the multi-tier game board 10 and to provide leg elements for placing the three-dimensional chess board 10 on a horizontal surface for play; all such constructions are regarded as being within the spirit and scope of the invention.

Figure 5:
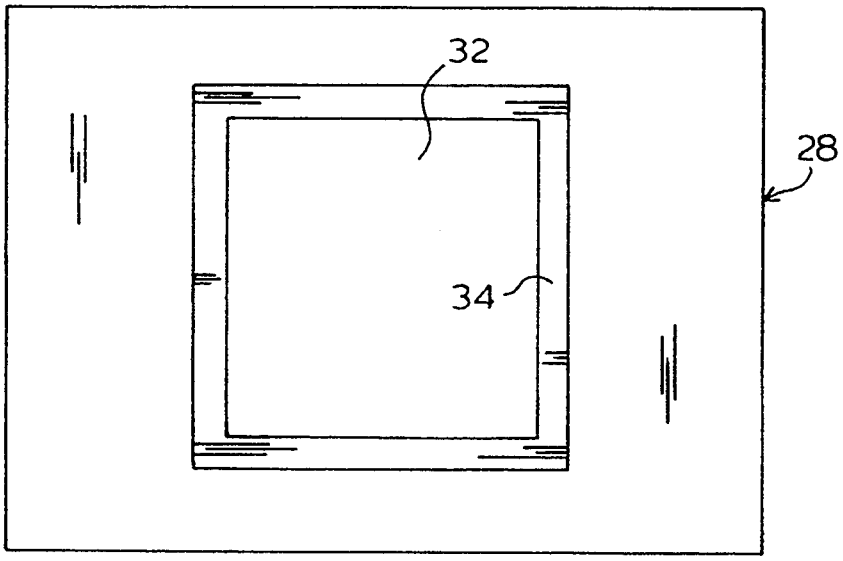
FIG. 5 is a top planar view of a table.

In another preferred embodiment for supporting the multi-tiered game board 10, the upper surface 30 of a table 28 has a receiving hole 32 penetrating therethrough (FIG. 5). The receiving hole 32 is shaped to receive the game board 10. The table 28 has a lip 34 located along the edge of receiving hole 32 to engage the lower surface 13 of upper tier 12 of game board 10 and support the game board 10 thereon.

Figure 4:
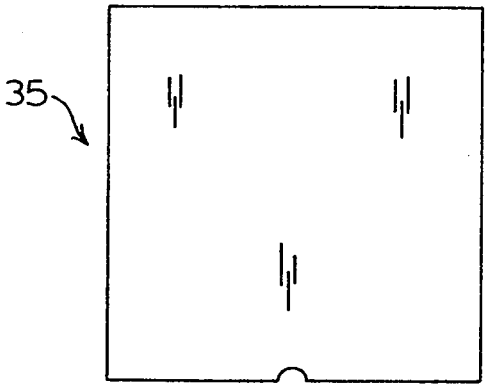
FIG. 4 is top planar view of cover panel showing hand notch.
Figure 6:
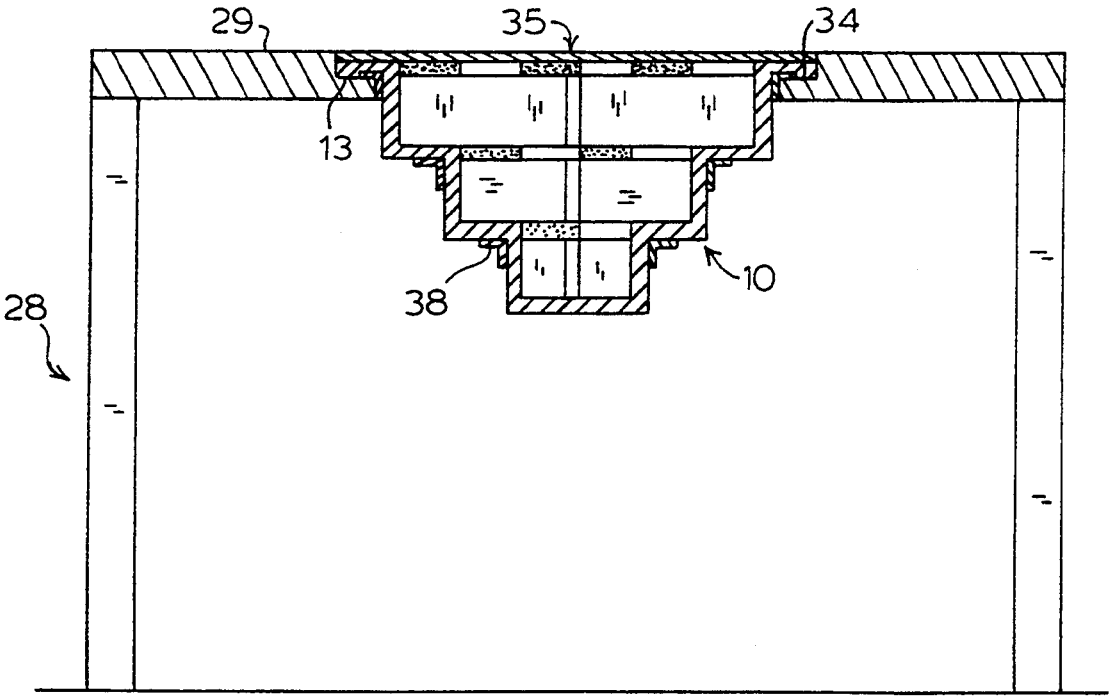
FIG. 6 is a cross-sectional view of table taken along line 6—6 of FIG. 5 illustrating use of a detached cover panel.

The game board 10 preferably has a removable cover panel 35 with a hand notch 50 for allowing fingers to grasp an edge of cover panel to remove from game board 10, as illustrated in FIGS. 4, and 6. Hand notch 50 may be located through the center of cover panel 35, or through an edge of cover panel 35 as illustrated in FIG. 4, or any other convenient position through cover panel 35.

Figure 7:
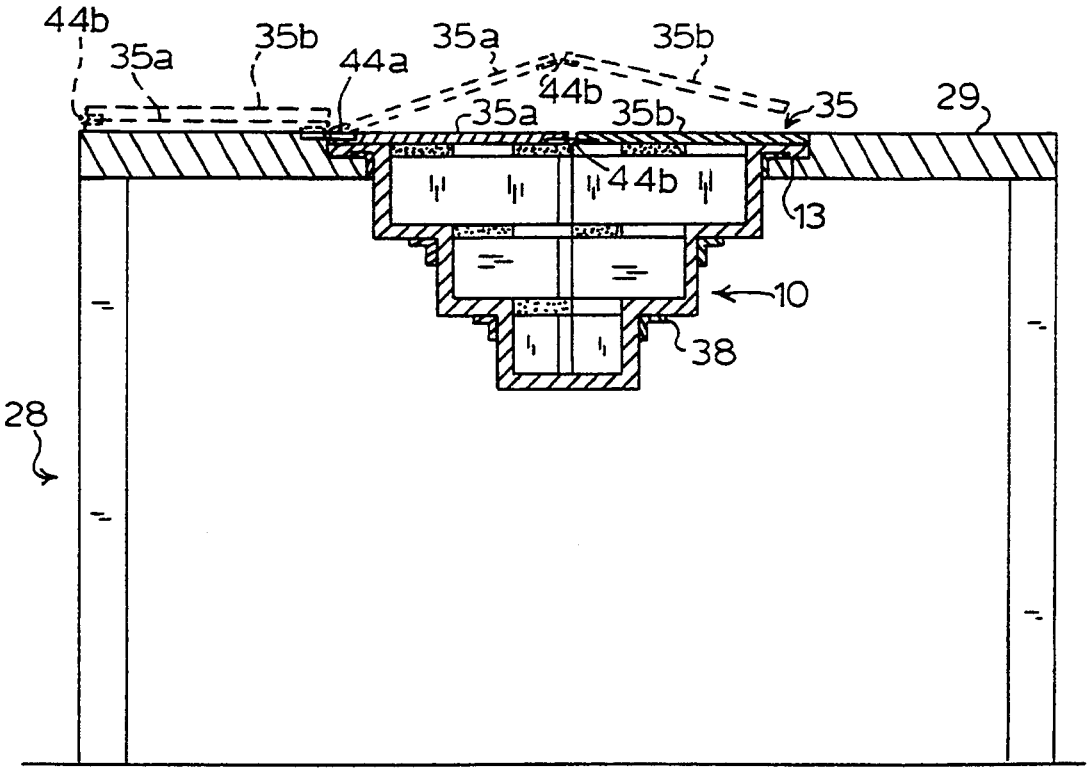
FIG. 7 is a cross-sectional view similar to FIG. 6 and assumed to have been taken along line 6—6 of FIG. 5 but with a hingable cover panel.
Figure 8:
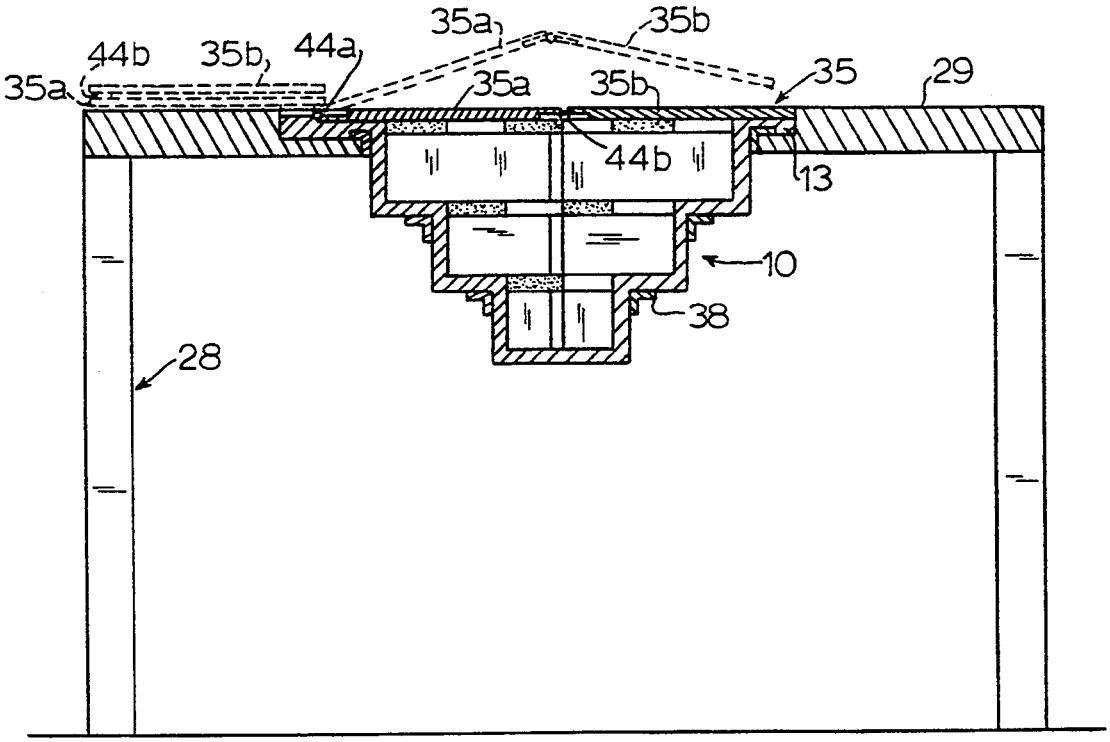
FIG. 8 is a partial cross-sectional view of a cover panel hingeable to the game board.

In one embodiment of the cover for the multi-tiered game board 10, depicted in FIG. 7, a folding bifurcated cover panel 35 is shown in a closed and open position. Folding cover panel 35 has a first section **35*a* and a second section 35*b*, 35*a* being hingedly connected to the table 28 by at least one hinge 44*a*. At least one hinge 44*b* interconnects section 35*a* and section 35*b*. As shown in FIG. 8, cover panel 35 may be hinged to game board 10. Various door and hinge combinations are known in the art may be used with the cover 35 for the game board 10** and are to be regarded as being within the spirit and scope of the invention.

In another preferred embodiment, the invention includes a computerized depiction of a three-dimensional board game such as chess. Thus, a computer game utilizing the invention could provide varying views of the three-dimensional board of the invention, having playing pieces positioned thereon, as viewed by the players, utilizing standard perspective depiction techniques, cutaway views or cross-sections as shown in the Figures herein, or other methods of depiction of three-dimensional surfaces.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A multi-dimensional game board comprising:

a. a plurality of horizontal tiers, each of said tiers having an upwardly facing playing surface enclosing a center space therebetween, said playing surfaces being arranged in an internally descending stepwise order, such that each successive internally descending playing surface is one step down, parallel to and immediately interior to the playing surface located immediately above;

b. a vertical support system to permanently support said tiers in a fixed, parallel, stepped relation to each other;

c. a supporting means attached to and extending downwardly from said game board for supporting said game board on a flat horizontal surface; and d. a table having an upper support surface with a receiving hole therethrough for receiving said game board, and a lip located along the edge of said receiving hole to engage said lower surface of said upper tier to support said game board upon said table.

2. A multi-dimensional game board as recited in claim 1, further comprising a removable cover panel for covering the top of said game board when not in use, wherein said removable cover panel has a hand notch.

3. A multi-dimensional game board as recited in claim 1, further comprising at least one hingedly connected cover panel for covering the top of said game board when not in use.

4. A multi-dimensional game board as recited in claim 3, wherein said hingedly connected cover panel is hingeable to said game board.

5. A multi-dimensional game board having a horizontal upwardly facing playing surface of sixty-four game piece position squares, each position square being one of two possible colors which alternate along the playing surface, comprising:

a. an upper tier having four sides forming a square, each of said sides having an upper and lower surface and enclosing a center space positioned therebetween, wherein said upper surface is a substantially horizontal upwardly facing playing surface one position square wide and eight position squares long;

b. a first intermediate tier having four sides forming a square, each of said sides having an upper and lower surface and enclosing a center space positioned therebetween, wherein said upper surface is a substantially horizontal upwardly facing playing surface located one step down, parallel to and immediately interior to said upwardly facing playing surface of said upper tier and is one position square wide and six position squares long;

c. a second intermediate tier having four sides forming a square, each of said sides having an upper and lower surface and enclosing a center space positioned therebetween, wherein said upper surface is a substantially horizontal upwardly facing playing surface located one step down, parallel to and immediately interior to said upwardly facing playing surface of said first intermediate tier and is one position square wide and four position squares long;

d. a lower tier having four sides forming a square, each of said sides having a substantially horizontal upwardly facing playing surface located one step down, parallel to and immediately interior to said upwardly facing playing surface of said second intermediate tier and is one position square wide and two position squares long;

e. a vertical support system interconnecting said tiers to permanently support said tiers in a fixed, parallel, stepped relation to each other; and f. a table having an upper support surface with a receiving hole therethrough for receiving said game board, and a lip located along the edge of said receiving hole to engage said lower surface of said upper tier to support said game board upon said table.

6. A multi-dimensional game board as recited in claim 5, further comprising a removable cover panel for covering the top of said game board when not in use, wherein said removable cover panel has a hand notch.

7. A multi-dimensional game board having a horizontal upwardly facing playing surface of sixty-four game piece position squares, each position square being one of two possible colors which alternate along the playing surface, comprising:

a. an upper tier having four sides forming a square, each of said sides having an upper and lower surface and enclosing a center space positioned therebetween, wherein said upper surface is a substantially horizontal upwardly facing playing surface one position square wide and eight position squares long;

b. a first intermediate tier having four sides forming a square, each of said sides having an upper and lower surface and enclosing a center space positioned therebetween, wherein said upper surface is a substantially horizontal upwardly facing playing surface located one step down, parallel to and immediately interior to said upwardly facing playing surface of said upper tier and is one position square wide and six position squares long;

c. a second intermediate tier having four sides forming a square, each of said sides having an upper and lower surface and enclosing a center space positioned therebetween, wherein said upper surface is a substantially horizontal upwardly facing playing surface located one step down, parallel to and immediately interior to said upwardly facing playing surface of said first intermediate tier and is one position square wide and four position squares long;

d. a lower tier having four sides forming a square, each of said sides having a substantially horizontal upwardly facing playing surface located one step down, parallel to and immediately interior to said upwardly facing playing surface of said second intermediate tier and is one position square wide and two position squares long;

e. a vertical support system interconnecting said tiers to permanently support said tiers in a fixed, parallel, stepped relation to each other; and f. at least one hingedly connected cover panel for covering the top of said game board when not in use.

8. A multi-dimensional game board as recited in claim 7, wherein said hingedly connected cover panel is hingeable to said table.

9. A multi-dimensional game board as recited in claim 7, wherein said hingedly connected cover panel is hingeable to said game board.

* * * * *